US006789688B2

(12) United States Patent
Roush et al.

(10) Patent No.: US 6,789,688 B2
(45) Date of Patent: Sep. 14, 2004

(54) EXPANDABLE DISPLAY RACK

(75) Inventors: Michael Paul Roush, Hixson, TN (US); Billy Ray Lofty, Red Bank, TN (US)

(73) Assignee: SMP Industries, Chattanooga, TN (US)

( * ) Notice: Subject to any disclaimer, the term of this patent is extended or adjusted under 35 U.S.C. 154(b) by 0 days.

(21) Appl. No.: 10/244,607

(22) Filed: Sep. 17, 2002

(65) Prior Publication Data

US 2004/0050814 A1 Mar. 18, 2004

(51) Int. Cl.[7] ..... A47B 47/00

(52) U.S. Cl. ..... 211/201; 211/90.02; 211/204

(58) Field of Search ..... 211/90.02, 200, 211/201, 202, 175, 204, 186, 187, 128.1, 207, 133.3, 103, 189, 195; 108/118, 106–108, 162, 188, 190; 280/79.3; 248/164, 149, 150, 431

(56) References Cited

U.S. PATENT DOCUMENTS 574,628 A * 1/1897 Phillips ..... 211/200
1,150,109 A * 8/1915 Flanders ..... 211/200
1,511,805 A * 10/1924 Dunbar ..... 38/102.5
2,164,299 A * 6/1939 Mandell et al.
2,648,442 A * 8/1953 Lowmaster ..... 108/1
2,852,145 A * 9/1958 Scholz ..... 211/204
3,341,027 A * 9/1967 Mackin, Jr. et al. ..... 108/188
3,484,810 A * 12/1969 Boss ..... 108/152
3,608,504 A * 9/1971 Peters ..... 108/109
4,967,916 A * 11/1990 Handler et al. ..... 211/187
5,131,547 A * 7/1992 Goldberg ..... 211/149
5,738,019 A * 4/1998 Parker ..... 108/108
5,848,498 A * 12/1998 Szabo et al. ..... 52/36.1
5,899,346 A * 5/1999 Newkirk ..... 211/149
5,947,307 A * 9/1999 Battaglia et al. ..... 211/187
6,109,461 A * 8/2000 Kluge et al. ..... 211/90.01
6,112,918 A * 9/2000 Burgess ..... 211/186
6,286,694 B1 * 9/2001 Battaglia et al. ..... 211/187
6,637,608 B1 * 10/2003 Schneider ..... 211/90.02
6,666,344 B1 * 12/2003 Schneider ..... 211/90.02
2002/0027115 A1 * 3/2002 Gay et al. ..... 211/187

* cited by examiner

*Primary Examiner*—Jennifer E. Novosad
(74) *Attorney, Agent, or Firm*—Shoemaker and Mattare

(57) ABSTRACT

A display rack comprises a pair of vertical supports, and a number of shelves which can be placed at various locations on the supports. To accommodate shelves of different widths, the vertical supports are interconnected by diagonal braces whose angle can be changed to alter the spacing between the supports, while maintaining them parallel and vertical.

4 Claims, 3 Drawing Sheets

EXPANDABLE DISPLAY RACK

This application relates to display racks for merchandise such as food items.

BACKGROUND

Display racks for merchandise typically include a number of shelves and a support structure designed for those shelves. It is not possible to adjust the width of such display racks, to accommodate shelves of different widths.

SUMMARY OF THE INVENTION

An object of the invention is to provide a display rack with horizontal adjustability. This object is achieved by using a pair of individual vertical support assemblies, which are interconnected by diagonal braces having plural attachment points to the supports, or adjustable length.

DESCRIPTION OF THE PREFERRED EMBODIMENTS

Figure 1:
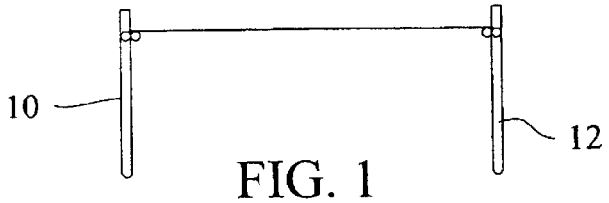
FIG. 1 is a top plan view of a display rack embodying the invention.
Figure 2:
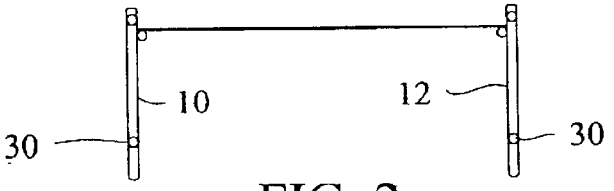
FIG. 2 is a bottom plan view thereof.
Figure 6:
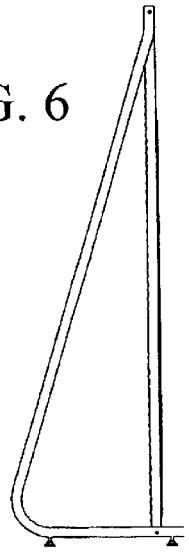
FIG. 6 is a right side view thereof, the left side view (not shown) being identical.
Figure 4:
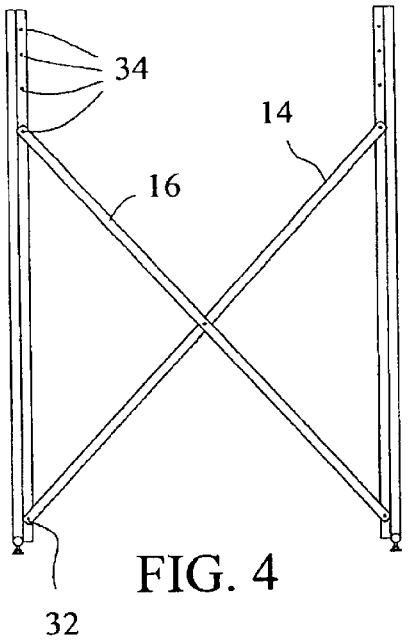
FIG. 4 is a rear elevation thereof.
Figure 5:
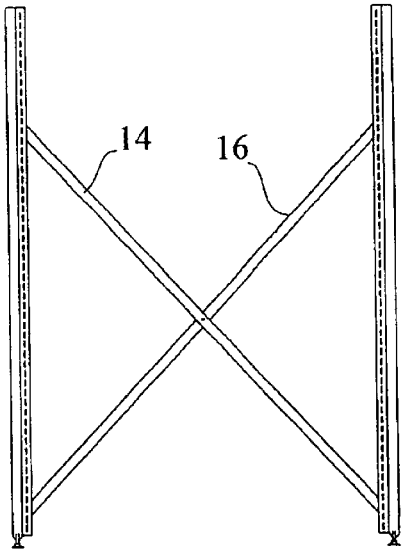
FIG. 5 is a front elevation thereof.
Figure 3:
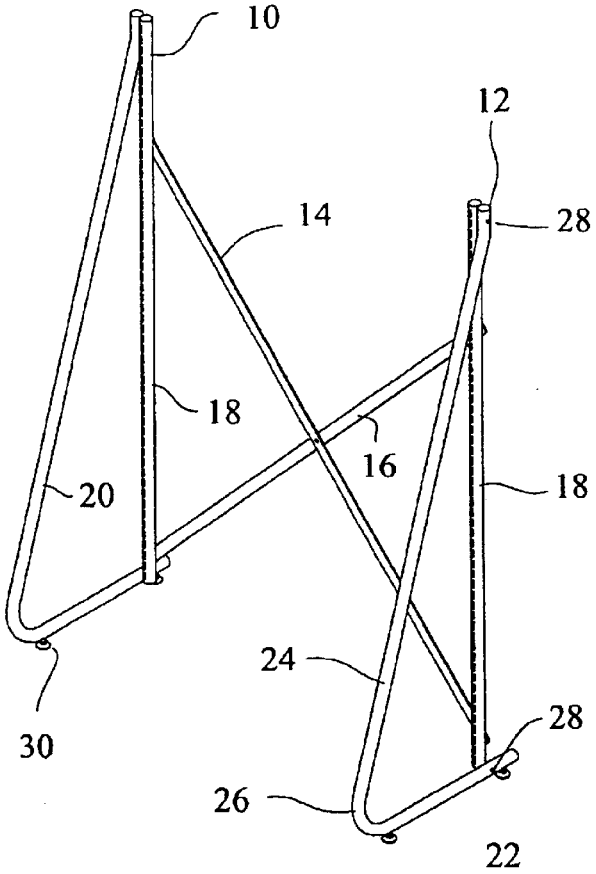
FIG. 3 is a perspective view thereof, taken from the front and right side.

FIGS. 1–7 show a display rack comprising a left vertical support assembly 10, a right vertical support assembly 12, and a pair of crossed diagonal braces 14, 16. Each of the vertical support assemblies is formed from a straight vertical tube 18 and a bent tube 20 having a horizontal segment 22 parallel to the floor and an oblique segment 24 extending upwardly and rearwardly from the bend 26 connecting the two segments. The ends of the vertical tube 18 are connected to the respective ends of the bent tube 20 by fasteners such as bolts 28. Other means of attachment such as welding might be used as an alternative. Two feet 30 are installed in the bottom of each of the horizontal segments 22.

The horizontal braces are attached to the vertical tubes 18 by fasteners such as screws which extend through holes at either end of each braces into holes in the vertical tubes. A single hole 32 is provided near the bottom of each vertical tube, and a number of vertically spaced holes 34 are formed at the upper end. One can easily adjust the spacing between the vertical support assemblies by placing the screws in different ones of the spaced holes 34.

Figure 7:
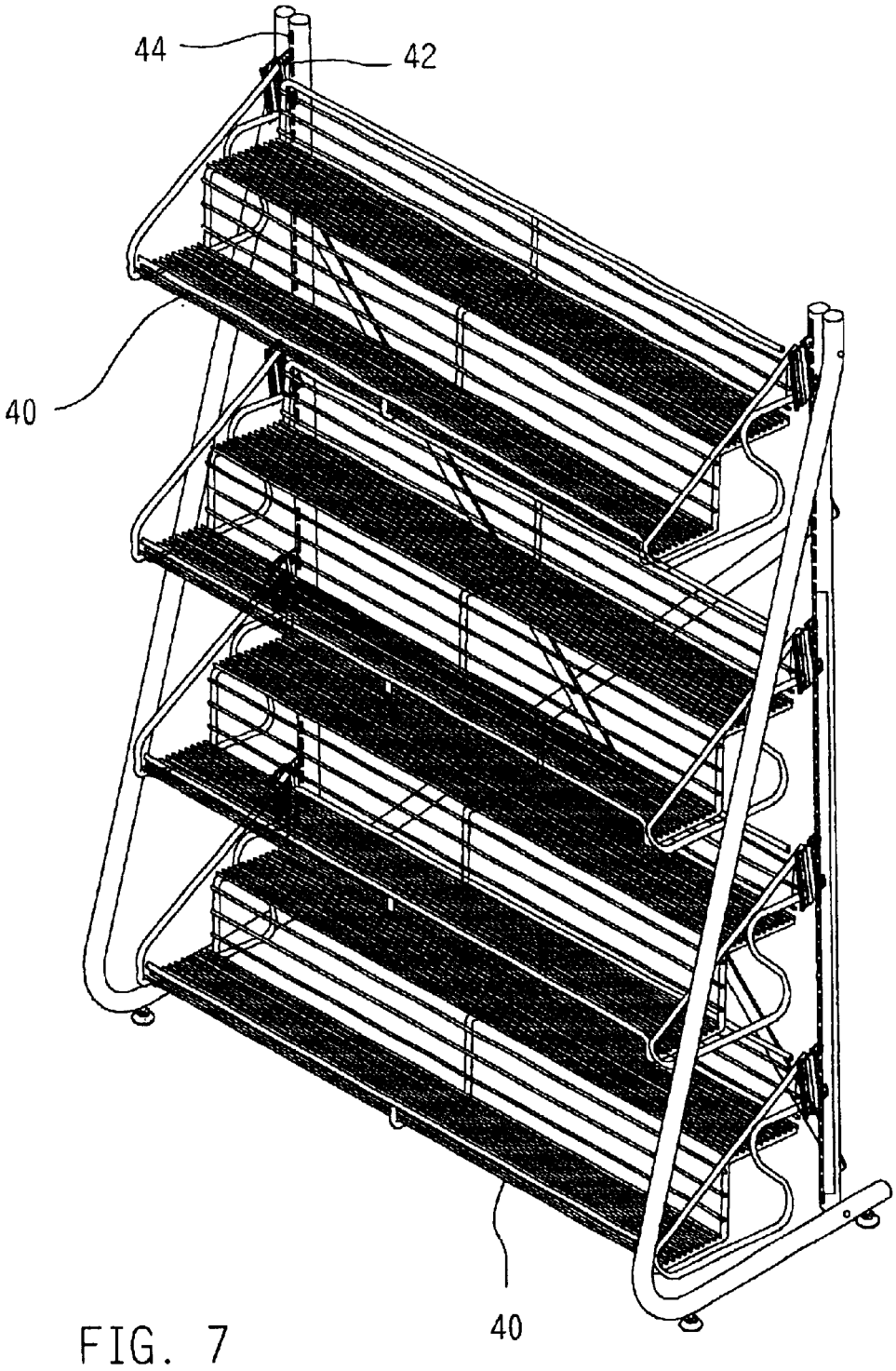
FIG. 7 is a view like FIG. 3, with shelves installed on the rack.

FIG. 7 shows the rack, completed by the addition of horizontal shelves 40. Each shelf is supported on the vertical tube by brackets having tabs 42 which seat in slots 44 in the front side of the vertical tubes. The height of the shelves can be independently adjusted in a well-known manner.

Figure 8:
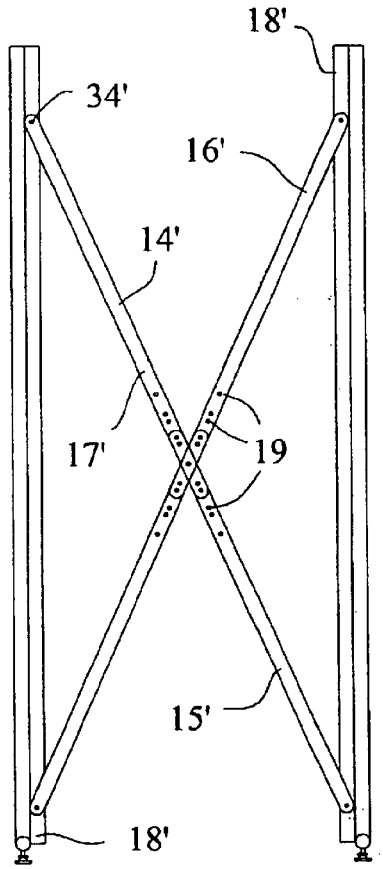
FIG. 8 is a rear elevation, like FIG. 4, showing a first modified form of the invention.

FIG. 8 shows an alternative form of the invention, wherein there is only a single screw hole 34' at the top of each tube 18'. In this case, the connection points between the braces and the posts cannot be changed to adjust the width of the rack. Instead, the diagonal braces 14' and 16' have plural holes 19 near their centers, for receiving bolts, screws or pins joining the braces together. In order to expand the rack, the two segments 15', 17' making up either brace are lengthened by removing the fasteners connecting them and reinserting the bolts in different holes. Conversely, the braces may be shortened to narrow the rack.

Inasmuch as the invention is subject to various modifications, it is intended that the foregoing description and the accompanying drawings shall be interpreted as merely illustrative of the invention defined by the following claims.

We claim:

1. An expandable display rack comprising a pair of vertical supports, at least one shelf, means for supporting the shelf horizontally on said vertical supports, a pair of diagonal braces interconnecting said vertical supports so as to maintain the support parallel to one another, connection points on each vertical support for respective ends of the braces, and wherein each of said diagonal braces comprises plural segments, each of said segments has plural holes extending through its thickness and spaced so as to receive fasteners in alternative holes so as to permit adjustment of the length of each brace so that the horizontal distance between the supports can be changed to accommodate shelves of different widths.

2. The expandable display rack of claim 1, wherein each of said vertical supports comprises a vertical tube having plural longitudinally spaced holes therein providing alternative locations for receiving a fastener securing one end of a respective diagonal brace to the tube.

3. The expandable display rack of claim 2, wherein the plural longitudinally spaced holes are disposed near an upper end of each vertical tube.

4. The expandable display rack of claim 1, wherein the means for supporting the shelf is vertically adjustable.

* * * * *